US009052627B2

(12) United States Patent
Iida et al.

(10) Patent No.: US 9,052,627 B2
(45) Date of Patent: Jun. 9, 2015

(54) TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

(75) Inventors: Yoshifumi Iida, Kanagawa (JP); Fusako Kiyono, Kanagawa (JP); Yasuaki Hashimoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 603 days.

(21) Appl. No.: 12/553,467

(22) Filed: Sep. 3, 2009

(65) Prior Publication Data

US 2010/0233605 A1 Sep. 16, 2010

(30) Foreign Application Priority Data

Mar. 13, 2009 (JP) ..... 2009-060831

(51) Int. Cl.

| | |
|---|---|
| ***G03G 9/00*** | (2006.01) |
| ***G03G 21/18*** | (2006.01) |
| ***G03G 15/08*** | (2006.01) |
| ***G03G 9/097*** | (2006.01) |
| ***G03G 9/087*** | (2006.01) |

(52) U.S. Cl.

CPC ..... *G03G 9/09725* (2013.01); *G03G 9/0872* (2013.01); *G03G 9/09708* (2013.01); *G03G 9/09716* (2013.01); *G03G 9/09733* (2013.01); *G03G 9/09775* (2013.01)

(58) Field of Classification Search

CPC ..... G03G 9/00; G03G 9/08; G03G 9/0815
USPC ..... 430/105, 108.11, 108.7, 108.23, 110.2; 399/111, 252
See application file for complete search history.

(56) References Cited

U.S. PATENT DOCUMENTS

| | | | | |
|---|---|---|---|---|
| 6,042,979 | A | 3/2000 | Ohishi et al. | |
| 6,214,512 | B1 * | 4/2001 | Takano et al. | 430/125.32 |
| 6,355,390 | B1 * | 3/2002 | Yamanami et al. | 430/60 |
| 6,479,206 | B1 | 11/2002 | Suzuki et al. | |
| 2006/0216624 | A1 * | 9/2006 | Ueda et al. | 430/108.4 |
| 2006/0275679 | A1 * | 12/2006 | Ishiyama et al. | 430/42 |

(Continued)

FOREIGN PATENT DOCUMENTS

| | | | |
|---|---|---|---|
| CN | 101004563 | A | 7/2007 |
| CN | 101140431 | A | 3/2008 |

(Continued)

OTHER PUBLICATIONS

Australian Office Action issued in Australian Patent Application No. 2009215230.

(Continued)

*Primary Examiner* — Christopher Rodee
*Assistant Examiner* — Rachel Zhang
(74) *Attorney, Agent, or Firm* — Oliff PLC

(57) ABSTRACT

A toner for electrostatic charge image development has toner mother particles including a release agent, a colorant, and a binder resin including a crystalline resin, and an external additive to the toner mother particles including at least metatitanic acid and at least one selected from the group consisting of silicon oxide and fluoropolymer particles, and the addition weight ratio of the metatitanic acid to the at least one selected from the group consisting of silicon oxide and fluoropolymer particles is from 1:0.08 to 1:8.30 is provided.

20 Claims, 2 Drawing Sheets

(56) References Cited

U.S. PATENT DOCUMENTS

| | | | | |
|---|---|---|---|---|
| 2007/0166636 | A1 | 7/2007 | Daimon et al. | |
| 2007/0231723 | A1* | 10/2007 | Kimura et al. | 430/108.1 |
| 2008/0057430 | A1 | 3/2008 | Takahashi et al. | |
| 2008/0199799 | A1 | 8/2008 | Tsurumi et al. | |
| 2008/0241716 | A1* | 10/2008 | Ishikawa et al. | 430/48 |

FOREIGN PATENT DOCUMENTS

| | | |
|---|---|---|
| JP | A-2000-305311 | 11/2000 |
| JP | A-2007-178869 | 7/2007 |
| JP | A-2008-064859 | 3/2008 |

OTHER PUBLICATIONS

Feb. 7, 2013 Office Action issued in Chinese Patent Application No. 200910173862.3 (with English translation).

Dec. 14, 2012 Office Action issued in Korean Patent Application No. 10-2009-0086897 (with English translation).

Apr. 18, 2012 Office Action issued in Chinese Patent Application No. 2009-10173862.3 (with translation).

* cited by examiner

TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

CROSS-REFERENCE TO RELATED APPLICATIONS

This application is based on and claims priority under 35 USC 119 from Japanese Patent Application No. 2009-060831, filed Mar. 13, 2009.

BACKGROUND

1. Technical Field

The present invention relates to a toner for electrostatic charge image development, an electrostatic charge image developer, a toner cartridge, a process cartridge and an image forming device.

2. Related Art

Methods such as electrophotographic methods that visualize image information using an electrostatic latent image are currently in use in many fields. In an electrophotographic method, an electrostatic latent image formed on a photoreceptor by a charging process and an exposure process is developed by developer that includes toner, and is visualized via a transfer process and a fixing process.

Developers used in development include two-component developer including toner and a carrier, and one-component developer which is toner that is used alone such as magnetic toner. In two-component developers, the functions of stirring, transporting and charging the developer are allotted to the carrier. Since some of the functions of the developer are performed by the carrier rather than the toner, the two-component developer can be controlled favorably and is currently in widespread use.

SUMMARY

According to an aspect of the invention, there is provided a toner for electrostatic charge image development, including: toner mother particles including a release agent, a colorant, and a binder resin including a crystalline resin; and an external additive to the toner mother particles, the external additive including at least metatitanic acid and at least one selected from the group consisting of silicon oxide and fluoropolymer particles, wherein the addition weight ratio of the metatitanic acid to the at least one selected from the group consisting of silicon oxide and fluoropolymer particles is from approximately 1:0.08 to approximately 1:8.30.

BRIEF DESCRIPTION OF THE DRAWINGS

Exemplary embodiments of the present invention will be described in detail based on the following figures, wherein.

DETAILED DESCRIPTION

Figure 1:
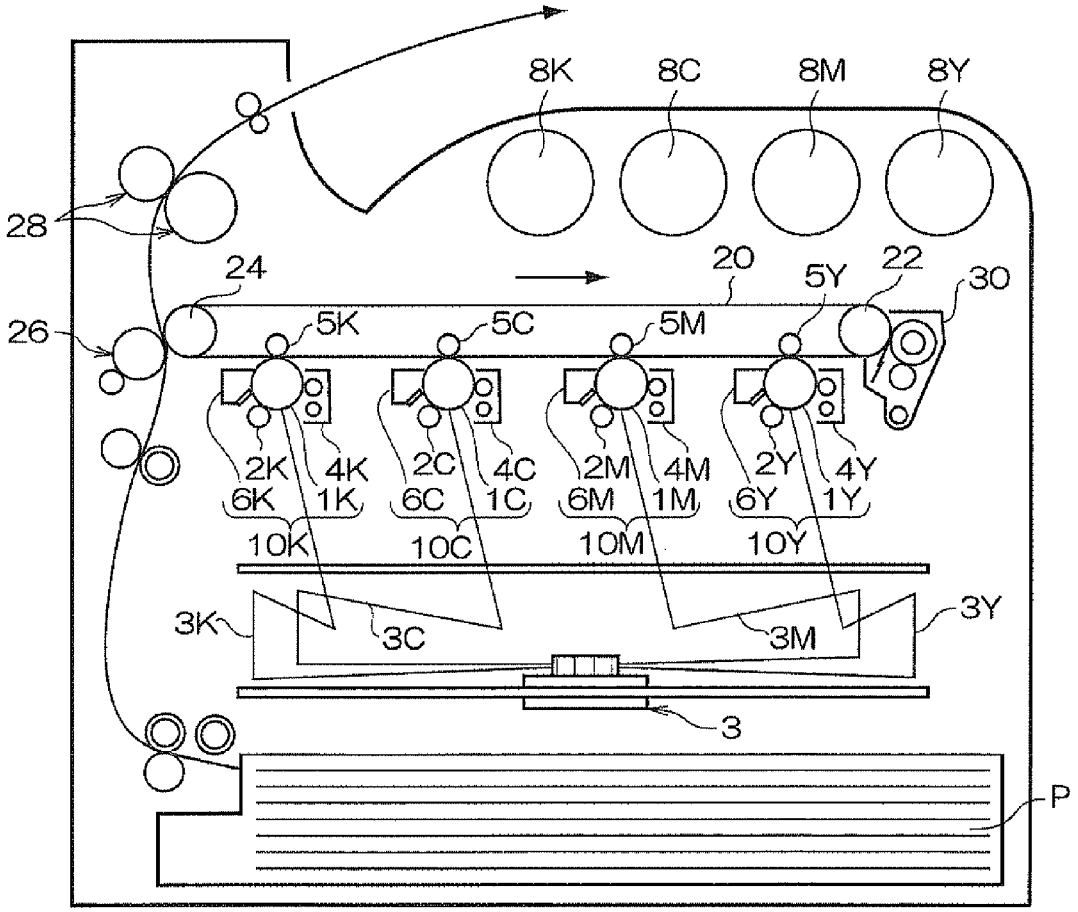
FIG. 1 is a schematic drawing showing an example of the image forming device of an present exemplary embodiment.

In the following, exemplary embodiments of a toner for electrostatic charge image development, an electrostatic charge image developer, a toner cartridge, a process cartridge and an image forming device of the present invention are explained in detail.

Toner for Electrostatic Charge Image Development

The toner for electrostatic charge image development of the present exemplary embodiment includes at least toner mother particles containing a release agent, a colorant and a binder resin including a crystalline resin, and, as external additives for the toner mother particles, at least metatitanic acid and at least one selected from the group consisting of silicon oxide and fluoropolymer particles, with the addition weight ratio of the metatitanic acid to the at least one selected from the group consisting of silicon oxide and fluoropolymer particles being from 1:0.08 to 1:8.30 (or from approximately 1:0.08 to approximately 1:8.30).

The reason why the lightfastness of the colorant is improved by adopting the above configuration is surmised to be as follows. Metatitanic acid particles have a plate-shaped configuration. Because of the particular method of manufacture, this plate-shaped configuration is not formed by one particle but, rather, is formed from an aggregate body of a number of small-diameter particles. As a result, the surface of the plate-shaped configuration is uneven. This plate-shaped configuration has strong adhesion to toner, has high external additive adhesion strength, and does not easily detach from a toner. Further, by performing surface treatment on the metatitanic acid, the dispersibility of the metatitanic acid on the toner surface is improved. In addition, since wet treatment is performed according to the method of manufacture, the treatment amount can be increased as compared to dry treatment. As a result, the surface of the metatitanic acid is hydrophobized and the dispersibility of the metatitanic acid is improved. In view of the above properties, when metatitanic acid is used, it serves as an external additive on a toner surface in a state of strongly adhering to the toner surface and being favorably dispersed. As a result, metatitanic acid is present in the uppermost layer of an image surface after fixing, thereby directly protecting the toner from ultraviolet rays.

However, compared to use of metatitanic acid alone, lightfastness is further improved when at least one selected from the group consisting of silicon oxide and fluoropolymer particles is added. When metatitanic acid is used alone, a certain degree of lightfastness can be expected; however, when embedding of the external additive occurs, the effect of the metatitanic acid is reduced. This is because, due to the fact that the metatitanic acid is strongly fixed to the toner surface, there is no movement (rolling on the toner) of the metatitanic acid as a result of, for example, agitation stress with a carrier, because the metatitanic acid directly receives the stress and is embedded. Therefore, the embedded portion is a portion of the toner with almost no external additive at the surface thereof. As a result, there are portions of the image surface after fixing at which no metatitanic acid is present, which results in variation in lightfastness across the surface of an image.

With respect to this embedding of metatitanic acid, combined use of metatitanic acid and at least one selected from the group consisting of silicon oxide and fluoropolymer particles works to suppress the above trend. When silicon oxide and/or fluoropolymer particles are used together with metatitanic acid, lightfastness may be improved as compared to when metatitanic acid is used alone; however, combined use of fluoropolymer particles with metatitanic acid is more preferable. The particle diameter of the fluoropolymer particles is preferably from 100 nm to 500 nm and more preferably from 150 nm to 300 nm. Conventionally, particles having this particle diameter range have been used as spacer materials.

While resin particles such as acrylic particles can also be used as spacer materials, these are problematic in terms of dispersibility on the toner surface and low electrification.

In contrast, since fluoropolymer particles are low surface energy materials, the following effects can be expected. In places where there is no embedding of metatitanic acid on the surface of toner that has been coated with metatitanic acid, the effect of the hydrophobicity of the metatitanic acid and the low surface energy of the fluoropolymer particles is that the fluoropolymer particles do not adhere to the toner. Further, at portions where the metatitanic acid is embedded and the toner surface has no external additive, adhesiveness is usually increased and fluoropolymer particles concentrate at these portions. At this time, detached external additives (metatitanic acid, and silicon oxide or the like in a case in which silicon oxide is added) are adsorbed onto the fluoropolymer particles. As a result, portions at which metatitanic acid is embedded have a configuration whereby fluoropolymer particles that have adsorbed a detached external additive are added to these portions. Even when fluoropolymer particles that have adhered once receive stress from a carrier or the like, the fluoropolymer particles themselves are squashed or likewise and an embedding alleviation action operates. It is thought that the presence of metatitanic acid is uniform with respect to the image surface after fixing as a result of the foregoing.

In the following, to begin with, the respective components used in the toner for electrostatic charge image development of the present exemplary embodiment are explained.

Toner Mother Particles

The toner mother particles include at least a crystalline resin, a colorant and a release agent. A non-crystalline resin and the additives described below may be included as necessary.

Binder Resin

In the toner for electrostatic charge image development (also simply referred to as "toner" in the following) of the present exemplary embodiment, at least a crystalline resin is used as a binder resin in the toner mother particles. The fixing temperature is reduced by use of a crystalline resin. Combined use of a crystalline resin and a non-crystalline resin is more preferable. When these resins are used in combination as the binder resin, by ensuring an appropriate degree of even mixing, sharp melt properties and low-temperature fixability may be exhibited due to the plasticizing effect of the evenly mixed portion in addition to the sharp melt properties originally held by the crystalline resin. Further, the dispersibility of the crystalline resin may be improved and the strength of the toner may be improved by an appropriate degree of even mixing.

The content ratio of the crystalline resin and the non-crystalline resin in the toner mother particles, by weight ratio (crystalline resin:non-crystalline resin), is preferably from 4:96 to 20:80 (or from approximately 4:96 to approximately 20:80), more preferably from 6:94 to 15:85 and yet more preferably from 8:92 to 10:90.

In addition, crystalline resin as used herein refers to a resin which, in differential scanning calorimetry (DSC), has a clear endothermic peak rather than stepwise changes in endothermic amount. Specifically, the term refers to a resin for which the half-width of the endothermic peak is 6° C. or less when measured at a temperature increase rate of 10° C./min.

Further, non-crystalline resins are resins for which the half-width of the endothermic peak exceeds 6° C. or which do not show a clear endothermic peak. In the present exemplary embodiment, resins that do not show a clear endothermic peak are preferably used as non-crystalline resins.

The crystalline resin is not particularly limited as long as it is a resin that has crystallinity, and specific examples include crystalline polyester resins and crystalline vinyl resins, with crystalline polyester resins being preferable and aliphatic crystalline polyester resins being more preferable.

The crystalline polyester resin used in the toner of the present exemplary embodiment and all other polyester resins are synthesized from a polyvalent carboxylic acid component and a polyhydric alcohol component. In addition, in the present exemplary embodiment, either a commercial product or a synthesized product may be used as the polyester resin.

Examples of the polyvalent carboxylic acid component include: aliphatic dicarboxylic acids such as oxalic acid, succinic acid, glutaric acid, adipic acid, suberic acid acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid and 1,18-octadecane dicarboxylic acid; and aromatic dicarboxylic acids such as dibasic acids such as phthalic acid, isophthalic acid, terephthalic acid, naphthalene-2,6-dicarboxylic acid, malonic acid and mesaconic acid. Further examples include, but are not limited to, anhydrides and lower alkyl esters of these acids. One of these acids may be used singly, or two or more may be used in combination.

Examples of tri- or higher-valent carboxylic acids include 1,2,4-benzene tricarboxylic acid, 1,2,5-benzene tricarboxylic acid, 1,2,4-naphthalene tricarboxylic acid and anhydrides and lower alkyl esters thereof. One of these acids may be used singly, or two or more may be used in combination.

In addition to the aliphatic dicarboxylic acids and aromatic dicarboxylic acids described above, a dicarboxylic acid component having a double bond may be included. Dicarboxylic acids having a double bond radically cross-link via the double bond and thus are favorable in view of preventing hot offset at the time of fixing.

Examples of dicarboxylic acids having a double bond include maleic acid, fumaric acid, 3-hexenedioic acid and 3-octanedioic acid, but are not limited thereto. Further examples include lower esters and acid anhydrides thereof. Among these, fumaric acid and maleic acid are preferable in terms of cost.

Further, preferable examples of the polyhydric alcohol include aliphatic diols, and straight-chain aliphatic diols having a carbon number of from 7 to 20 in the main chain portion are more preferable. When the aliphatic diol is a straight-chain diol, because the crystallinity of the polyester resin is maintained and reduction in the fusing temperature is inhibited, anti-toner blocking properties, image storability and low-temperature fixability may be excellent. Further, when the carbon number is from 7 to 20, the melting temperature at the time of condensation polymerization with an aromatic carboxylic acid may be low and low-temperature fixing may be achieved; in addition, in practical terms, materials may be easily obtained. The carbon number of the main chain portion is more preferably from 7 to 14.

Specific examples of the aliphatic diol that can be favorably used in synthesis of the crystalline polyester according to the present exemplary embodiment include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanic decanediol. One of these may be used singly, or two or more may be used in combination.

Among these, in view of ease of procurement, 1,8-octanediol, 1,9-nonanediol and 1,10-decanediol are preferable.

Examples of tri- or higher-hydric alcohols include glycerin, trimethylol ethane, trimethylol propane and pentaerythritol. One of these may be used singly, or two or more may be used in combination.

Among the polyhydric alcohol components, the content of the aliphatic diol component is preferably 80 mol % or more, and more preferably 90 mol % or more. When the content of the aliphatic diol component is in this range, the crystallinity of the polyester resin is maintained and reduction in the melting temperature is inhibited, whereby excellent anti-toner blocking properties, image storability and low-temperature fixability may be obtained.

In addition, in the crystalline polyester according to the present exemplary embodiment, a monovalent acid such as acetic acid or benzoic acid, a monohydric alcohol such as cyclohexanol or benzyl alcohol may be used as necessary in order to adjust the acid value, the hydroxyl group value or the like.

The method of producing the crystalline polyester resin is not particularly limited, and the crystalline polyester resin is produced by a general polyester polymerization method of reacting an acid component with an alcohol component. Examples of the method include direct polycondensation and ester exchange methods, and the method of production may be determined in accordance with the kinds of monomer.

Production of the crystalline polyester resin may be carried out at a polymerization temperature of from 180° C. to 230° C. and as necessary, the reaction may be carried out in a reduced pressure reaction system while removing water and alcohol generated by the condensation. When the monomer does not dissolve or evenly mix at the reaction temperature, a high boiling-temperature solvent may be added as a solubilizing agent and the monomer dissolved thereby. The polycondensation reaction is performed while removing the solubilizing agent. When a monomer having poor compatibility is present in the copolymerization reaction, it is advisable to condensate the monomer having poor compatibility in advance with the acid or alcohol that was to be polycondensated with the monomer, and then to polycondensate the resultant with the main component.

The crystalline polyester resin particle dispersion liquid is prepared by emulsion dispersion including adjustment of the acid value of the resin and/or using an ionic surfactant.

Examples of the catalyst used in the production of the crystalline polyester resin include: alkaline metal compounds such as sodium or lithium; alkaline earth metal compounds such as magnesium or calcium; metal compounds such as zinc, manganese, antimony, titanium, tin, zirconium or germanium; phosphorous acid compounds; phosphoric acid compounds; and amine compounds, and specific examples include the following compounds:

Sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl)phosphite, ethyl triphenyl phosphonium bromide, triethylamine and triphenylamine.

Examples of crystalline vinyl resins include vinyl resins formed from (meth)acrylates of long-chain alkyls or alkenyls such as amyl(meth)acrylate, hexyl (meth)acrylate, heptyl (meth)acrylate, octyl(meth)acrylate, nonyl(meth)acrylate, decyl (meth)acrylate, undecyl(meth)acrylate, tridecyl(meth) acrylate, myristyl(meth)acrylate, cetyl(meth)acrylate, stearyl (meth)acrylate, oleyl(meth)acrylate and behenyl(meth)acrylate.

In addition, in the present specification, use of the term "(meth)acrylate" or "(meth)acrylic" denotes inclusion of both "methacrylate" and "acrylate" or of both "methacrylic" and "acrylic".

The melting temperature of the crystalline resin is preferably from 50° C. to 100° C. (or from approximately 50° C. to approximately 100° C.), more preferably from 60° C. to 80° C., and still more preferably from 55° C. to 70° C. When the melting temperature of the crystalline resin is within the above range, superior toner storability and toner image storability after fixing may be obtained and low-temperature fixability may be exhibited.

In addition, although there are cases when a crystalline resin exhibits plural melting peaks, the melting temperature in the present exemplary embodiment is taken from the maximum peak.

The crystalline resin preferably has a weight-average molecular weight (Mw), as measured by a molecular weight determination according to gel permeation chromatography (GPC) of a tetrahydrofuran (THF) soluble part, of from 5000 to 60,000 (or from approximately 5000 to approximately 60,000), and more preferably from 8000 to 50,000, a number-average molecular weight (Mn) preferably of from 4000 to 10,000, and a molecular weight distribution (Mw/Mn) preferably of from 2 to 10 and more preferably of from 3 to 9.

When the weight-average molecular weight and the number-average molecular weight are in these ranges, it may be easy to achieve both low-temperature fixability and anti-hot offset properties.

Among the components of the toner mother particles, the crystalline resin is preferably used in a range of from 5 weight % to 30 weight % and more preferably in a range of from 8 weight % to 20 weight %.

When the content of the crystalline resin is in the above range, the strength of the fixed image, and particularly the resistance to scratching, may be high and it may be difficult to form scratches and, further, sharp melt properties derived from the crystalline resin may be obtained, low-temperature fixability is secured, and anti-toner blocking properties and image storability may be exhibited.

A non-crystalline resin may be used as the binder resin of the toner of the present exemplary embodiment in addition to, and in combination with, the crystalline resin described above.

Known resin materials may be used as the non-crystalline resin, and a non-crystalline polyester resin is preferable. Non-crystalline polyester resins that can be used in the present exemplary embodiment are mainly those obtained by condensation polymerization of polyvalent carboxylic acids and polyhydric alcohols.

Use of a non-crystalline polyester resin is advantageous in that it is easy to prepare a resin particle dispersion liquid by emulsion dispersion including adjustment of the acid value of the resin and/or using an ionic surfactant.

Examples of polyvalent carboxylic acids include: aromatic carboxylic acids such as terephthalic acid, isophthalic acid, phthalic anhydride, trimellitic anhydride, pyromellitic acid and naphthalene dicarboxylic acid; aliphatic carboxylic acids such as maleic anhydride, fumaric acid, succinic acid, alkenyl succinic anhydride and adipic acid; and alicyclic carboxylic acids such as cyclohexane dicarboxylic acid. One of these polyvalent carboxylic acids may be used singly, or two or more may be used in combination.

Among these polyvalent carboxylic acids, aromatic carboxylic acids are preferably used and, in order to ensure favorable fixability by taking a cross-linked or branched structure, a tri- or higher valent carboxylic acid (such as trimellitic acid or an anhydride thereof) may be used in combination with a dicarboxylic acid.

Examples of polyhydric alcohols include: aliphatic diols such as ethylene glycol, diethylene glycol, triethylene glycol, propylene glycol, butane diol, hexane diol, neopentyl glycol and glycerin; alicyclic diols such as cyclohexane diol, cyclohexane dimethanol and hydrogenated bisphenol A; and aromatic diols such as an ethylene oxide adduct of bisphenol A and a propylene oxide adduct of bisphenol A. One of these polyhydric alcohols may be used singly, or two or more may be used in combination.

Among these polyhydric alcohols, aromatic diols and alicyclic diols are preferable, and, among these, aromatic diols are more preferable. Further, in order to ensure favorable fixability and a cross-linked or branched structure, a tri- or higher hydric alcohol (such as glycerin, trimethylol propane or pentaerythritol) may be used in combination with a diol.

In addition, a monocarboxylic acid and/or a monoalcohol may be added to a polyester resin obtained by polycondensation of a polyvalent carboxylic acid and a polyhydric alcohol, the hydroxyl group and/or the carboxyl group at the polymer terminal esterified, and the acid value of the polyester resin adjusted.

Examples of the monocarboxylic acids include acetic acid, acetic anhydride, benzoic acid, trichloroacetic acid, trifluoroacetic acid and propionic anhydride, and examples of the monoalcohols include methanol, ethanol, propanol, octanol, 2-ethylhexanol, trifluoroethanol, trichloroethanol, hexafluoroisopropanol and phenol.

The polyester resin is produced by condensation reacting the above polyhydric alcohol and polyvalent carboxylic acid according to a normal method. For example, the polyhydric alcohol and polyvalent carboxylic acid and, optionally, a catalyst, are placed and blended in a reaction vessel equipped with a thermometer, a stirring device and a downward flow condenser and are heated at from 150° C. to 250° C. in the presence of an inert gas (such as nitrogen gas), low-molecular compounds generated as by-products are continuously removed from the reaction system, the reaction is stopped at the time when the predetermined acid value has been reached, the resultant is cooled and the intended reactant is obtained.

Examples of the catalyst used when synthesizing this polyester resin include esterified catalysts such as organic metals like dibutyltin dilaurate, dibutyltin oxide and metal alkoxides like tetrabutyl titanate. The addition amount of the catalyst may be from 0.01 weight % to 1.00 weight % with respect to the total amount of raw materials.

The non-crystalline resin used in the toner mother particles according to the present exemplary embodiment preferably has a weight-average molecular weight (Mw), as measured by molecular weight determination according to gel permeation chromatography (GPC) of a tetrahydrofuran (THF) soluble part, of from 5000 to 1,000,000 (or from approximately 5000 to approximately 1,000,000), and more preferably from 7000 to 500,000, a number-average molecular weight (Mn) preferably of from 2000 to 10,000, and a molecular weight distribution (Mw/Mn) preferably of from 1.5 to 100 (or from approximately 1.5 to approximately 100) and more preferably of from 2 to 60.

When the weight-average molecular weight and the number-average molecular weight are in these ranges, it may be easy to achieve each of low-temperature fixability, anti-hot offset properties and document storability.

Further, in the present exemplary embodiment, the molecular weight of the resin is calculated by measuring a THF-soluble substance in a THF solvent using TOSOH CORPORATION's GPC•HLC-8120 and Column•TSKgel SuperHM-M (15 cm) and calculating the molecular weight using a molecular weight correction curve formed using a standard sample of monodispersed polystyrene.

The acid value of the non-crystalline resin (number of milligrams of KOH needed to neutralize 1 g of the resin) may be from 1 mgKOH/g to 30 mgKOH/g in view of ease of obtaining the above molecular weight distribution, ease of securing the granulation properties of toner particles by emulsification dispersion, and ease of preserving favorable environmental stability (stability of charging properties when the temperature or humidity changes) of the obtained toner.

The acid value of the non-crystalline resin can be adjusted by controlling the number of carboxyl groups at terminals of the polyester, by adjusting the compounding ratio and the rate of reaction of the polyhydric alcohol and polyvalent carboxylic acid raw materials. Alternatively, a resin having a carboxyl group in the main chain of the polyester may be obtained by using trimellitic anhydride as the polyvalent carboxylic acid component.

Further, styrene acrylic resins may be used as known non-crystalline resin. Examples of monomers thereof include the monomer of styrenes such as styrene, parachlorostyrene and α-methyl styrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinyl nitrites such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; and olefins such as ethylene, propylene and butadiene. The non-crystalline resin includes polymer thereof or copolymer obtained by combining two or more thereof, or mixtures thereof. In addition, non-vinyl condensation resins such as epoxy resin, polyester resin, polyurethane resin, polyamide resin, cellulose resin and polyether resin, or a mixture of these and the above vinyl resins, or graft polymer obtained when polymerizing vinyl monomer in the presence of any of these, may be used.

The glass transition temperature of the non-crystalline resin used in the present exemplary embodiment is preferably from 35° C. to 100° C. and, in view of the balance between toner storage properties (the degree to which an aggregate tends not to form as a result of shaking during transport or heat) and toner fixability, is more preferably from 50° C. to 80° C.

When the glass transition temperature of the non-crystalline resin is within this range, blocking (a phenomenon whereby toner particles aggregate to form clusters) during storage or while contained in a developer device may be prevented and the fixing temperature of the toner may be kept low.

The softening temperature of the non-crystalline resin is preferably in the range of from 80° C. to 130° C. (or from approximately 80° C. to approximately 130° C.) and, more preferably, in the range of 90° C. to 120° C.

When the softening temperature of the non-crystalline resin is in this range, the storage property of the toner in a toner cartridge and the image stability after fixing (suppression of image defects such as image detachment and/or cracks when bent) may be excellent, and low-temperature fixability may be also excellent.

The softening temperature of the non-crystalline resin refers to the intermediate temperature between the temperature at the initiation of melting and the temperature at the completion of melting, when using a Flow Tester (CFT-500C; manufactured by Shimadzu Corporation) under the conditions of: prewarming; 80° C./300 seq; plunger pressure: 0.980665 MPa; die size: 1 mmΦ×1 mm; and rate of temperature increase: 3.0° C./min.

In the present exemplary embodiment, in view of improving the charging and storage properties by encapsulating the release agent, the toner mother particles may be configured such that the toner has a core portion forming the central portion of the toner particles and a shell portion formed to enclose the core portion.

When the toner mother particles according to the present exemplary embodiment contains a combination of a crystalline resin and a non-crystalline resin as the binder resin, the respective resins may exist within the toner in any configuration. In view of having the crystalline resin spread evenly at the toner surface and improving the charging and storage properties, toner mother particles that include the crystalline resin at the core portion are preferable.

Further, the core portion may include both the crystalline resin and the non-crystalline resin in view of improving storage properties by evenly mixing the crystalline resin and the non-crystalline resin.

The content ratio of the crystalline resin and the non-crystalline resin in the core portion (crystalline resin; non-crystalline resin) is, by weight ratio, preferably from 2:98 to 166:84, more preferably from 3:97 to 16:84, and still more preferably from 4:96 to 15:85.

Use of the non-crystalline resin as binder resin at the shell portion is preferable in view of prevention of exposure of the release agent component and the crystalline resin component from the core portion and improving the charging and storage properties.

The content ratio of the crystalline resin and the non-crystalline resin at the shell portion (crystalline resin:non-crystalline resin) is, by weight ratio, preferably from 0:100 to 2:98, more preferably from 0:100 to 1:99, and still more preferably from 0:100 to 0.5:99.5.

Release Agent

The release agent used in the toner mother particles according to the present exemplary embodiment may be a substance having a main endothermic peak as measured in compliance with ASTMD 3418-8 in the range of from 50° C. to 140° C. (or from approximately 50° C. to approximately 140° C.). When the main endothermic peak is in this range, occurrence of offset at the time of fixing may be suppressed, and the image surface may have favorable smoothness and excellent gloss.

A DCS-7, for example, manufactured by PerkinElmer Co., Ltd. is used in the measurement of the main endothermic peak. Temperature correction in the detection portion of this device uses the melting temperatures of indium and zinc, and the melting heat of indium is used in correction of the heat amount. An aluminum pan is used for the sample, an empty pan is set for comparison, and measurement is performed at a rate of temperature increase of 10° C./min.

Further, the viscosity $\eta 1$ of the release agent at 160° C. may be in the range of from 20 mPa·s to 200 mPa·s (or from approximately 20 mPa·s to approximately 200 mPa·s). When the viscosity $\eta 1$ is in this range, the occurrence of hot offset at high fixing temperatures and excessive bleeding of wax in the fixed image (also referred to as "wax offset" below) may be suppressed.

The ratio of the viscosity $\eta 1$ of the release agent at 160° C. and the viscosity $\eta 2$ at 200° C. ($\eta 2/\eta$) may be in the range of 0.5 to 0.7. When $\eta 2/\eta 1$ is in this range, occurrence of hot offset and wax offset may be suppressed and release stability may be excellent.

Specific examples of the release agent include: low-molecular polyolefins such as polyethylene, polypropylene and polybutene; silicones having a softening temperature as a result of heating; and fatty acid amides such as oleic amide, erucic amide, ricinolic amide and stearic amide; plant-based waxes such as carnauba wax, rice wax, candelilla wax, Japan wax and jojoba oil; animal-based waxes like beeswax; mineral and oil-based waxes such as montan wax, ozocerite, ceresin, paraffin wax, microcrystalline wax and Fischer-Tropsch wax; and modified versions thereof.

The release agents is dispersed in water together with a polyelectrolyte such as an ionic surfactant, a high-molecular acid, or a high-molecular base, and particulated using a homogenizer or a pressure discharge disperser that can apply strong shear while heating to no lower than the melting temperature of the release agent, whereby a release agent dispersion liquid including particles of the release agent having a particle diameter of 1 μm or less is produced.

Among the components of the toner mother particles, the release agent is preferably used in a range of from 0.5 weight % to 15 weight %, and more preferably in a range of from 1 weight % to 12 weight %.

When the content ratio of the release agent is within this range, stable charge properties may be exhibited even over long-term use, and the image surface may have favorable smoothness and excellent gloss.

Colorant

The colorant used in the toner mother particles according to the present exemplary embodiment is not particularly limited and known colorants may be used, selected according to purpose. Known organic or inorganic pigments and dyes or oil-soluble dyes may be used as the colorant.

Examples of black pigment include carbon black and magnetic powder.

Examples of yellow pigment include Hanza Yellow, Hanza Yellow 10G, Benzidine Yellow G, Benzidine Yellow GR, Threne Yellow, Quinoline Yellow and Permanent Yellow NCG.

Examples of red pigment include Bengara, Watchyoung Red, Permanent Red 4R, Lithol Red, Brilliant Carmine 3B, Brilliant Carmine 6B, Dupont Oil Red, Pyrazolone Red, Rhodamine B Lake, Lake Red C, Rose Bengal, Eoxine Red and Alizarine Lake.

Examples of blue pigment include Prussian Blue, Cobalt Blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate. Further, these may be mixed or may be used in a solid dispersion state.

The pigment is dispersed by a known method and, for example, media dispersers such as rotation-shear homogenizers, ball mills, sand mills or attritors, or high-pressure opposed-collision dispersers, may be used. Further, the pigment is dispersed in an aqueous solvent using a polarized ionic surfactant and the above-described homogenizer to prepare a colorant particle dispersion liquid.

When a pigment is used as the toner colorant of the present exemplary embodiment, one pigment may be used singly or two or more pigments of the same class may be used in a mixture. Further, two or more pigments of a different class may be used in a mixture.

Further, dye may be used as the toner colorant of the present exemplary embodiment, examples of which include various kinds of acridine, xanthene, azo, benzoquinone, azine, anthraquinone, dioxadine, thiazine, azomethine, indigo, thioindigo, phthalocyanine, aniline black, polymethine, triphenyl methane, diphenyl methane and thiazole dyes. Further examples include dispersed dyes and oil-soluble dyes.

One dye may be used singly or two or more dyes of the same class may be used in a mixture. Further, two or more dyes of a different class may be used in a mixture. In addition, dyes and pigments may be used in combination.

When a monoazo pigment or a naphthol pigment is used as the colorant used in the toner mother particles according to the present exemplary embodiment, there may be a remarkable improvement in lightfastness, which is one of the effects of the present invention.

The content of the colorant may be from 1 to 30 parts by weight relative to 100 parts by weight of the binder resin. Within this numerical range, a higher value is preferable as long as the smoothness of the image surface after fixing is not impaired. When the content of the colorant is increased and an image with the same density obtained, the thickness of the image can be reduced, which may be effective in prevention of offset.

Method of Producing Toner Mother Particles

In the following, a method of producing toner mother particles is explained, with particular reference to a method of producing toner mother particles having a core/shell structure.

The toner mother particles according to the present exemplary embodiment may be produced by a wet production method involving production in an acidic or alkaline aqueous medium. Examples of the wet production method include an aggregation coalescence method, a suspension polymerization method, a dissolution suspension granulation method, a dissolution suspension method and a dissolution emulsification aggregation coalescence method and, in particular, an aggregation coalescence method is preferable.

When method of producing toner of the present exemplary embodiment is production by an aggregation coalescence method, the method may include at least the below-described first aggregation process, the below-described second aggregation process, and the below-described fusion coalescence process.

First Aggregation Process

A resin particle dispersion liquid in which first resin particles are dispersed, a colorant particle dispersion liquid in which colorant particles are dispersed, and a release agent particle dispersion liquid in which release agent particles are dispersed are mixed to form core aggregate particles including the first resin particles, colorant particles and release agent particles.

Second Aggregation Process

A shell layer including second resin particles is formed on the surface of the core aggregate particles to provide core/shell aggregate particles.

Fusion Coalescence Process

The core/shell aggregate particles are heated to a temperature equal to or higher than the glass transition temperature of the first resin particles or the second resin particles and, thereby, fused and coalesced.

In the first aggregation process, a resin particle dispersion liquid, a colorant particle dispersion liquid and a release agent particle dispersion liquid are first prepared.

The resin particle dispersion liquid is prepared by dispersing first resin particles, which have been prepared by emulsion polymerization or the like, in a solvent using an ionic surfactant.

The colorant particle dispersion liquid is prepared by dispersing, in a solvent, colorant particles of a desired color such as black, blue, red or yellow using an ionic surfactant having the opposite polarity to the ionic surfactant used when preparing the resin particle dispersion liquid.

The release agent particle dispersion liquid is prepared by dispersing a release agent in water together with a polyelectrolyte such as an ionic surfactant, a high-molecular acid or a high-molecular base, and particulating the resultant using a homogenizer or a pressure discharge disperser that can apply strong shear while heating to no lower than the melting temperature.

Next, the resin particle dispersion liquid, the colorant particle dispersion liquid and the release agent particle dispersion liquid are mixed, and the first resin particles, the colorant particles and the release agent particles are heteroaggregated to form aggregate particles (core aggregate particles) having a diameter close to the desired toner diameter and including the first resin particles, the colorant particles and the release agent particles.

In the second aggregation process, second resin particles are attached to the surface of the core aggregate particles obtained in the first aggregation process using a resin particle dispersion liquid including the second resin particles and a covering layer (shell layer) is formed at a desired thickness, whereby aggregate particles (core/shell aggregate particles) having a core/shell structure in which a shell layer is formed at the surface of the core aggregate particles are obtained. Further, the second resin particles used here may be the same as or different from the first resin particles.

The particle diameter of the first resin particles, the second resin particles, the colorant particles and the release agent particles used in the first and second aggregation processes is preferably 1 μm or less, and more preferably in the range of from 100 nm to 300 nm, in order to facilitate adjustment of toner diameter and particle size distribution to desired values.

The particle diameter of resin particle dispersion liquid obtained thus is measured, for example, using a Laser Scattering Particle Size Distribution Analyzer (LA-700; manufactured by Horiba Ltd.).

In the first aggregation process, the balance between the amounts of the ionic surfactants (dispersants) having different polarities included in the resin particle dispersion liquid and the colorant particle dispersion liquid may be offset in advance. For example, using a polymer of an inorganic metal salt such as calcium nitrate or a polymer of an inorganic metal salt such as barium sulfate, the offset is ionically cancelled and the core aggregate particles are produced by heating at a temperature no higher than the glass transition temperature of the first resin particles.

In this case, in the second aggregation process, a resin particle dispersion liquid that has been treated with a dispersant in an amount and having a polarity that compensates the imbalance of the dispersants having different polarities, is added to the solution including the core aggregate particles and core/shell aggregate particles are produced by, if necessary, slightly heating at a temperature equal to or lower than the glass transition temperature of either the core aggregate particles or the second resin particles used in the second aggregation process. The first and second aggregation processes may be performed in stages with multiple repetitions.

Next, in the fusion coalescence process, the core/shell aggregate particles obtained via the second aggregation process are heated, in the solution, to a temperature equal to or higher than the glass transition temperature of the first or second resin particles included in the core/shell aggregate particles (when there are two or more kinds of resin, this refers to the glass transition temperature of the resin having the highest glass transition temperature) and toner is obtained by fusion coalescence.

Upon completion of the fusion coalescence process, the toner formed in the solution is washed, subjected to solid-liquid separation and dried by known methods and a toner is obtained in a dried state.

The washing process may be performed by displacement washing using a sufficient amount of ion-exchange water in view of charge properties. The solid-liquid separation process is not particularly limited, and may be performed by suction filtration or pressure filtration in view of productivity. The drying process is not particularly limited either, but methods such as freeze dehydration, flash jet drying, fluidized drying and vibro-fluidized drying may be used in view of productivity.

Physical Properties of Toner Mother Particles

The volume-average particle diameter of the toner mother particles is preferably from 3 μm to 9 μm, more preferably from 3.5 μm to 8.5 μm, and still more preferably from 4 μm to 8 μm.

The volume-average particle diameter of the toner mother particles may, for example, be measured using a Coulter Multisizer II. The specific method of measurement is described in the Examples.

The shape factor of the toner mother particles is preferably from 115 to 140, more preferably from 118 to 138, and still more preferably from 120 to 136.

Herein, the shape factor SF1 is calculated according to the following equation (1).

$$SF1=(ML^2/A)\times(\pi/4)\times 100 \quad \text{(Equation (1))}$$

In equation (1), ML indicates the absolute maximum length of the toner particles and A indicates the projected area of the toner particles.

Shape factor SF1 is numerically quantified mainly by analysis of a microscopic image or a scanning electron microscopic (SEM) image using an image analysis device. The specific method of measurement is described in the Examples.

External Additive

In the toner of the present exemplary embodiment, the toner mother particles include at least metatitanic acid and at least one selected from the group consisting of silicon oxide and fluoropolymer particles as external additives. Other external additives may be additionally added to the toner of the present exemplary embodiment.

Metatitanic Acid

Metatitanic acid is titanium acid hydrate $TiO_2.nH_2O$ in which n=1.

In the present exemplary embodiment, a compound synthesized by a sulfuric acid hydrolysis reaction may be used as the metatitanic acid. The hydrophobizing treatment method for the metatitanic acid is not particularly limited and a known hydrophobizing treatment agent may be used for the treatment. The hydrophobizing treatment agent is not particularly limited and examples include coupling agents such as a silane coupling agent, a titanate coupling agent or an aluminum coupling agent, and silicone oil. One of these may be used singly or two or more kinds may be used in combination.

Any kind of chlorosilane, alkoxysilane, silazane or specialty silylation agent may be used as the silane coupling agent, and specific examples include methyl trichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethoxysilane, diphenyl diethoxysilane, isobutyl triethoxysilane, decyl trimethoxysilane, hexamethyl disilazane, N,O-(bistrimethylsilyl)acetoamide, N,N-(trimethylsilyl)urea, tert-butyl dimethyl chlorosilane, vinyl trichlorosilane, vinyl trimethoxysilane, vinyl triethoxysilane, γ-methacryloxypropyl trimethoxysilane, β-(3,4-epoxycyclohexyl)ethyl trimethoxysilane, γ-glycidoxypropyl trimethoxysilane, γ-glycidoxypropyl methyl diethoxysilane, γ-mercaptopropyl trimethoxysilane and γ-chloropropyl trimethoxysilane. Further, examples of other coupling agents include titanate coupling agents and aluminum coupling agents.

In order to perform hydrophobizing treatment using a coupling agent, it is sufficient to add the coupling agent to a metatitanic acid slurry.

The amount of the coupling agent used for the treatment is preferably from 5 parts by weight to 80 parts by weight relative to 100 parts by weight of metatitanic acid, and more preferably from 10 parts by weight to 50 parts by weight. When the treatment amount is less than 5 parts by weight, there are cases when it is not possible to impart water repellency to the metatitanic acid and, when the treatment amount exceeds 80 parts by weight, there are cases when the treatment agent itself aggregates and surface treatment is not performed evenly.

Examples of silicone oil used in the hydrophobizing treatment include dimethyl silicone oil, fluorine-modified silicone oil and amino-modified silicone oil.

An example of a method of hydrophobizing treatment using silicone oil is a general spray-dry method; however, the method is not particularly limited as long as surface treatment can be performed.

The treatment amount of silicone oil is preferably from 10 parts by weight to 40 parts by weight relative to 100 parts by weight of metatitanic acid, and more preferably from 20 parts by weight to 35 parts by weight.

In the present exemplary embodiment, metatitanic acid that has been subjected to hydrophobizing treatment using an alkoxysilane is preferable in terms of treatment results (a high degree of hydrophobizing is achieved).

The number average particle diameter of the metatitanic acid is preferably from 10 nm to 50 nm (or from approximately 10 nm to approximately 50 nm), more preferably from 15 nm to 45 nm, and still more preferably from 20 nm to 40 nm.

The amount of metatitanic acid included in the toner as an external additive is preferably from 0.3 parts by weight to 1.6 parts by weight relative to 100 parts by weight of the toner mother particles, and more preferably from 0.5 parts by weight to 1.2 parts by weight. When the amount added is less than 0.3 parts by weight, the toner surface coating ratio is reduced and there are cases when problems occur such as deterioration of the powder flow properties or an increase in variations in the charge amount caused by the environment. When the amount added exceeds 1.6 parts by weight, while the toner surface coating ratio increases, the metatitanic acid is susceptible to detachment and there are cases when detached metatitanic acid attaches to the carrier and reduces the charging capacity.

Silicon Oxide

In the present exemplary embodiment, silicon oxide produced by a general combustion method or sol-gel method may be used. Examples of the method of hydrophobizing treatment for the silicon oxide include HMDS treatment, treatment with a silane coupling agent and oil treatment.

In the present exemplary embodiment, silicon oxide that has been subjected to hydrophobizing treatment with hexamethyl disilazane (HMDS) may be used in view of toner flow properties (powder flow properties) after addition.

The method of hydrophobizing treatment of silicon oxide using HMDS is not particularly limited as long as treatment can be effected.

After the silicon oxide has been subjected to hydrophobizing treatment with HMDS, fragmentation treatment may be performed using a ball mill, a Henschel mixer or the like.

The number-average particle diameter of the silicon oxide may be from 30 nm to 180 nm (or from approximately 30 nm to approximately 180 nm); however, in the present exemplary embodiment, silicon oxide that has been subjected to hydrophobizing treatment and has a number-average particle diameter of from 30 nm to 60 nm and silicon oxide that has been subjected to hydrophobizing treatment and has a number-average particle diameter of from 90 nm to 150 nm may be used in combination.

The amount of silicon oxide included in the toner as an external additive is preferably from 0.5 parts by weight to 2.5 parts by weight relative to 100 parts by weight of the toner mother particles, and more preferably from 0.7 parts by weight to 2.0 parts by weight. When the amount added is less than 0.5 parts by weight, there are cases when the spacer effect is insufficient. When the amount added exceeds 2.5 parts by weight, the silicon oxide may detach from the toner particles causing image quality defects such as white spots.

Further, when two or more kinds of silicon oxide are used, the amount of silicon oxide included in the toner as an external additive refers to the sum of the amounts of the two or more kinds of silicon oxide.

In order to ensure that the number-average particle diameter of the metatitanic acid is in the range of from 10 nm to 50 nm, it is sufficient to use metatitanic acid having, for example, a volume-average particle diameter of from 5 nm to 60 nm as an external additive.

In order to ensure that the number-average particle diameter of the silicon oxide is in the range of from 30 nm to 180 nm, it is sufficient to use silicon oxide having, for example, a volume-average particle diameter of from 20 nm to 200 nm as an external additive.

Fluoropolymer Particles

Fluoropolymer particles may be used as an external additive in the toner of the present exemplary embodiment. Examples of the fluoropolymer particles include polytetrafluoroethylene (PTFE), tetrafluoroethylene (TFE)/hexafluoropropylene copolymer and tetrafluoroethylene (TFE)/perfluoroalkyl vinyl ether copolymer and, in view of charge properties, water repellency, oil repellency, weathering resistance and heat resistance, polytetrafluoroethylene (PTFE) and tetrafluoroethylene (TFE)/hexafluoropropylene copolymer are preferable, and polytetrafluoroethylene (PTFE) is more preferable.

The weight-average molecular weight of the fluoropolymer particles used in the present exemplary embodiment may be from 200,000 to 800,000 (or approximately 200,000 to approximately 800,000), more preferably from 300,000 to 600,000, and still more preferably from 350,000 to 550,000. When the molecular weight is lower than 200,000, there are cases when fluoropolymer particles are squashed at the time of external addition and the dispersion state becomes uneven. When the molecular weight exceeds 800,000, there are cases when the particles detach when subjected to stress (detaching from the toner surface because particles having this molecular weight are very hard when the molecular weight exceeds 800,000) resulting in an increase in portions of the toner surface at which the additive is not present. When the molecular weight is within the desired range, a favorable external additive state may be maintained, as a result of which the lightfastness of the colorant may be improved.

The amount of fluoropolymer particles included in the toner as an external additive is preferably from 0.1 parts by weight to 0.8 parts by weight (or from approximately 0.1 parts by weight to approximately 0.8 parts by weight) relative to 100 parts by weight of the toner mother particles, and more preferably from 0.15 parts by weight to 0.5 parts by weight.

The weight ratio of the metatitanic acid to the at least one selected from the group consisting of silicon oxide and fluoropolymer particles added to the toner mother particles as external additives is preferably from 1:0.08 to 1:8.30, more preferably from 1:0.20 to 1:6.00 and still more preferably from 1:0.20 to 1:4.50. When the weight ratio is within this range, the lightfastness of the colorant may be improved.

Other Additives

In addition to the above components, various other components such as internal additives, charge control agents, inorganic powder (inorganic particles) and organic particles may be added to the toner according to the present exemplary embodiment, as necessary.

Examples of the internal additives include magnetic substances such as metals (for example, ferrite, magnetite, reduced iron, cobalt, nickel or manganese), alloys, or compounds including these metals.

Inorganic particles are added for a variety of reasons, but may be added in order to adjust the viscoelasticity of the toner. Adjustment of the viscoelasticity enables adjustment of the degree of image gloss and the degree of penetration into paper. Examples of inorganic particles include known inorganic particles such as silica particles, titanium oxide particles, alumina particles, cerium oxide particles, or any of these particles that have had the surfaces thereof subjected to hydrophobizing treatment, and these kinds of particles may be used singly or in combination of two or more kinds thereof. Silica particles having a smaller refractive index than the binder resin may be used in view of maintaining coloring properties and transparency properties such as OHP transmittance. Further, the silica particles may be subjected to various surface treatments, and silica particles that have been surface-treated using, for example, a silane coupling agent, a titanium coupling agent or silicone oil may be used.

Toner Properties

The volume-average particle diameter of the toner in the present exemplary embodiment is preferably in the range of from 4 μm to 9 μm, more preferably in the range of from 4.5 μm to 8.5 μm, and yet more preferably in the range of from 5 μm to 8 μm. When the volume-average particle diameter is less than 4 μm, toner flow properties are impaired and the charge properties of the respective particles tend to deteriorate. Further, because the charge distribution is wide, background fogging, spillage of toner from the developer and the like tend to occur. In addition, when the volume-average particle diameter is less than 4 μm, there are cases when cleaning becomes very much more difficult. When the volume-average particle diameter exceeds 9 μm, resolution is reduced, as a result of which there are cases when sufficient image quality cannot be obtained and the demand for high image quality of recent years cannot be satisfied.

Further, the volume-average particle diameter here is measured using a Multisizer II (manufactured by Beckman Coulter, Inc.) with an aperture diameter of 50 μm. The measurement is performed after dispersing the toner in an electrolytic aqueous solution (for example, ISOTON solution manufactured by Beckman Coulter Inc.) and dispersing for at least thirty seconds by ultrasound.

Production of Toner

The method of toner particle production according to the present exemplary embodiment is explained in the following.

When the toner particles according to the present exemplary embodiment are obtained using a kneading-pulverizing method, first, in the kneading process, the non-crystalline resin, the crystalline resin, the colorant, the release agent and other additives used as necessary are mixed in a mixer such as a Nauter Mixer or a Henschel Mixer, after which a kneaded substance is obtained by kneading in a single-screw or double-screw extruder, such as an EXTRUDER.

In the pulverizing-classification process, the kneaded substance obtained in the kneading process is rolled and cooled, after which fine pulverization is performed in mechanical or air flow pulverizers such as a Type I mill, a KTM or a jet mill. Thereafter, classification is performed using a classifier utilizing the Coanda effect such as an elbow jet, or an air classifier such as a turbo classifier or an ACUCUT, whereby toner particles are obtained.

The toner for electrostatic charge image development according to the present exemplary embodiment is produced by adding, to the toner mother particles obtained as described above, an external additive including at least metatitanic acid and at least one selected from the group consisting of silicon oxide and fluoropolymer particles, and mixing. The mixing is performed using, for example, a V blender, a Henschel mixer or a Lödige mixer. Further, as necessary, oversized toner particles may be removed using an oscillation sieve, an air power sieve or the like.

Electrostatic Charge Image Developer

The electrostatic charge image developer according to the present exemplary embodiment includes at least the toner for electrostatic charge image development according to the present exemplary embodiment.

The toner for electrostatic charge image development according to the present exemplary embodiment can be used on its own as one-component developer or can be used in two-component developer. When used in two-component developer, it is used in a mixture with a carrier.

The carrier that can be used in the two-component developer is not particularly limited and known carriers may be used. Examples include magnetic metals such as iron oxide, nickel or cobalt, magnetic oxides such as ferrite or magnetite, resin-coated carriers having a resin coating layer on the core surface, or magnetic-dispersed carriers. Further examples include resin-dispersed carriers in which a conductive material is dispersed in a matrix resin.

The electrical resistance of the carrier core may be from $1\times10^{7.5}$ Ω·cm to $1\times10^{9.5}$ Ω·cm (or from approximately $1\times10^{7.5}$ Ω·cm to approximately $1\times10^{9.5}$ Ω·cm). When the electrical resistance is less than $1\times10^{7.5}$ Ω·cm, there is a risk that the carrier will be imparted with charge and the carrier itself be developed when the concentration of toner in the developer is reduced due to repeated copying. On the other hand, when the electrical resistance exceeds $1\times10^{9.5}$ Ω·cm, there is a risk of deterioration of image quality due to a marked edge effect, pseudo-contours or the like. The core is not particularly limited as long as the above conditions are fulfilled, and examples thereof include magnetic metals such as iron, steel, nickel or cobalt, alloys of these with manganese, chrome, rare earth metals or the like, and magnetic oxides such as ferrite or magnetite. Among these, ferrite is preferable, and alloys thereof with manganese, lithium, strontium, magnesium or the like are more preferable, in view of core surface properties and core resistance.

In the carrier, fluorine resin that may be included in the resin coating may be selected according to the purpose thereof and examples include known resins such as fluorine resins such as polytetrafluoroethylene, polyvinyl fluoride, polyvinylidene fluoride and polychlorotrifluoroethylene. These may be used singly or in combination of two or more thereof.

In the carrier, the coating film that is applied using a coating resin may include at least resin particles and/or conductive particles dispersed therein. "Conductive" as used herein refers to conductivity having volume resistivity of less than $10^7$ Ω·cm as measured based on Japanese Industrial Standard K 7194 ("Testing Method for Resistivity of Conductive Plastics with a Four-Point Probe Array"). When resin particles are dispersed in the coating film, because the resin particles are evenly dispersed in the thickness direction of the film and in the carrier surface tangential direction, even if the coating film abrades when the carrier is used, the same surface shape is retained as when the carrier is not used, and favorable charge-imparting performance may be maintained with respect to the toner. When conductive particles are dispersed in the coating film, because the conductive particles are evenly dispersed in the thickness direction of the film and in the carrier surface tangential direction, even if the coating film abrades when the carrier is used, the same surface shape may be retained as when the carrier is not used, and deterioration of the carrier may be prevented. Further, the above effect may be exhibited also when both resin particles and conductive particles are dispersed in the coating film.

Examples of the resin particles include thermoplastic resin particles and thermosetting resin particles. Among these, thermosetting resin particles, with which it is relatively easy to raise the degree of hardness, are preferable and resin particles formed from a nitrogen-containing resin including a nitrogen atom are preferable in view of providing the toner with ability to charge negatively. Further, one kind of such resin particles may be used singly or two or more kinds may be used in combination. The average particle diameter of the resin particles is preferably from 0.1 μm to 2 μm, and more preferably from 0.2 μm to 1 μm. When the average particle diameter of the resin particles is less than 0.1 μm, the dispersibility of the resin particles in the coating film is poor, and when the average particle diameter exceeds 2 μm, the resin particles tend to detach from the coating film, as a result of which the primary effects of the resin particles may be lost. Examples of the conductive particles include particles of metal such as gold, silver or copper, carbon black particles, particles of semi-conductive oxide such as titanium oxide or zinc oxide, and particles of titanium oxide, zinc oxide, barium sulfate, aluminum borate or potassium titanate or the like that have been coated with tin oxide, carbon black, metal or the like. "Semi-conductive" as used herein means that the volume resistivity is from $10^7$ Ω·cm to $10^{11}$ Ω·cm as measured based on Japanese Industrial Standard K 7194 ("Testing Method for Resistivity of Conductive Plastics with a Four-Point Probe Array").

One kind of these particles may be used singly or two or more kinds may be used in combination. Among these, carbon black particles are preferable in view of favorable production stability, cost, conductivity and the like. While the kind of carbon black is not particularly limited, carbon black having DBP oil absorption of from 50 ml/00 g to 250 ml/100 g may be used in view of superior production stability.

In the carrier, specific examples of methods for coating the core (carrier core) surface with a coating resin include an immersion method of immersion in a coating film forming solution including a coating resin, a spray method of spraying a coating film forming solution onto the carrier core surface, and a kneader-coater method of mixing the carrier core with a coating film forming solution in a state in which the carrier core is suspended by an airflow and then removing the solvent. Among these, the kneader-coater method is preferable. The solvent used in the coating film forming solution is not particularly limited as long as only the resin particles are dissolved therein and may be selected from known solvents, examples of which include aromatic hydrocarbons such as toluene and xylene; ketones such as acetone and methyl ethyl ketone; and ethers such as tetrahydrofuran and dioxane.

In the two-component developer, the mixing ratio (weight ratio) of the toner according to the present exemplary embodiment and the above carrier (toner:carrier) is preferably in the range of from 1:100 to 30:100 and more preferably in the range of from 3:100 to 20:100.

Image Forming Device

Next an image forming device according to the present embodiment that uses a toner for electrostatic charge image development according to the present embodiment will be explained. The image forming device according to the present embodiment includes a latent image holder, a development unit that develops an electrostatic latent image formed on the latent image holder as a toner image with developer, a transfer unit that transfers the toner image formed on the latent image holder to a receiving material; a fixing unit that fixes the toner image transferred to the receiving material; a cleaning unit that removes residual transfer components from the latent image holder by wiping with a cleaning member; and uses the electrostatic charge image developer according to the present embodiment as the developer. An example of the image forming device according to the present embodiment is given below; however, the present invention is not limited thereto. The main portions shown in the drawings are described below, while descriptions of other elements are omitted.

In the present image forming device, a part that includes the development unit may have a cartridge structure (process cartridge) removably mounted to the main body of the image forming device (i.e., attachable to and detachable from the main body). As the process cartridge, the process cartridge according to the present embodiment, which is provided with at least a developer holder that accommodates the electrostatic charge image developer according to the present embodiment, may be used.

FIG. 1 is a schematic drawing showing the configuration of a 4-head tandem color image forming device which is an example of the image forming device according to the present embodiment. The image forming device shown in FIG. 1 is provided with first to fourth electrophotographic image forming units 10Y, 10M, 10C and 10K, which respectively output Yellow (Y), Magenta (M), Cyan (C) and Black (K) color images based on color-separated image data. Image forming units (hereinafter also referred to as "unit" or "units") 10Y, 10M, 10C and 10K are arranged horizontally in a line with predetermined distances therebetween. Units 10Y, 10M, 10C and 10K may each be a process cartridge removably mounted to the image forming device main body.

An intermediate transfer belt 20 is provided as an intermediate transfer member extending above each of the units 10Y, 10M, 10C and 10K as shown in the drawings. Intermediate transfer belt 20 is provided around a drive roller 22 and a support roller 24 that contact an inner surface of intermediate transfer belt 20, which are separated from left to right as shown in the drawings. Intermediate transfer belt 20 runs in a direction from the first unit 10Y to the fourth unit 10K. Support roller 24 is biased in a direction of separation from drive roller 22 by a spring or the like (not shown), such that a predetermined tension is applied to intermediate transfer belt 20 which is provided around support roller 24 and drive roller 22. At an image holding side surface of intermediate transfer belt 20, an intermediate transfer belt cleaning device 30 is provided that opposes drive roller 22. Toner in the four colors of yellow, magenta, cyan and black, which are stored respectively in toner cartridges 8Y, 8M, 8C and 8K are supplied, respectively, to developing devices 4Y, 4M, 4C and 4K of units 10Y, 10M, 10C and 10K.

The abovementioned four units 10Y, 10M, 10C and 10K each have a similar configuration and, therefore, only the first unit 10Y, which forms a yellow image and is provided at an upstream side in a running direction of the intermediate transfer belt, will be described as a representative unit. The components in the second to fourth units 10M, 10C and 10K are respectively designated by the letters M for magenta, C for cyan and K for black, similarly to the manner in which the equivalent components in the first unit 10Y is indicated by Y for yellow, and description thereof is omitted.

The first unit 10Y includes a photoreceptor 1Y that functions as a latent image holder. Around photoreceptor 1Y are provided, in this order, a charge roller 2Y which charges the surface of photoreceptor 1Y to a predetermined potential, an exposing device 3 that exposes the charged surface with a laser beam 3Y based on a color-separated image signal and forms an electrostatic latent image, a developing device 4Y that supplies charged toner to the electrostatic latent image and develops the electrostatic latent image, a first transfer roller 5Y (first transfer unit) that transfers the developed toner image to intermediate transfer belt 20, and a photoreceptor cleaning device 6Y that removes residual toner from the surface of photoreceptor 1Y after a first transfer. First transfer roller 5Y is provided at an inner side of intermediate transfer belt 20, and is positioned opposite photoreceptor 1Y. Further, primary transfer rollers 5Y, 5M, 5C and 5K are respectively connected to bias electrodes (not shown) that apply a primary transfer bias to each primary transfer roller. Each bias power source is controlled by a control unit (not shown) such that a transfer bias applied to each of the primary transfer rollers may be changed.

Next, an operation of forming a yellow image at the first unit 10Y will be explained. First, before image-forming operation is performed, the surface of photoreceptor 1Y is charged to from around −600 to around −800 volts by charge roller 2Y. Photoreceptor 1Y is formed by providing a photosensitive layer on a conductive substrate. This photosensitive layer normally has high resistance (about that of a normal resin), and possesses characteristics such that when it is irradiated with laser beam 3Y, the specific resistance of the portion irradiated with the laser changes. At the surface of the charged photoreceptor 1Y, laser beam 3Y is output via exposing device 3 according to image data for yellow sent from a control portion (not shown). Laser beam 3Y irradiates the photosensitive layer at the surface of photoreceptor 1Y, and thereby an electrostatic latent image having a printing pattern for yellow is formed at the surface of photoreceptor 1Y.

The electrostatic latent image is an image formed at the surface of photoreceptor 1Y by charging, where the specific resistance of an irradiated portion of the photosensitive layer is reduced due to laser beam 3Y such that charge at the surface of photoreceptor 1Y is discharged and charge at a portion not irradiated by laser beam 3Y remains, thereby forming the electrostatic latent image, i.e. a negative latent image. The electrostatic latent image formed at photoreceptor 1Y is conveyed to a predetermined developing position following the rotation of photoreceptor 1Y. At the developing position, the electrostatic latent image on photoreceptor 1Y is made into a visible image (a toner image) by developing device 4Y.

Developing device 4Y accommodates the yellow toner according to the present embodiment. The yellow toner undergoes frictional charging by agitation within developing device 4Y, has a charge with the same polarity (negative polarity) as that of a charge on photoreceptor 1Y, and is retained on a developer roll (developer holder). When the surface of photoreceptor 1Y passes developing device 4Y, yellow toner electrostatically adheres to latent image portions at which charge has been removed from the surface of photoreceptor 1Y, and the latent image is thereby developed with yellow toner. Photoreceptor 1Y, on which a yellow toner image has been formed, is then run at a predetermined speed, and the toner image developed on photoreceptor 1Y is conveyed to a predetermined primary transfer position.

When the yellow toner image on photoreceptor 1Y is conveyed to the primary transfer position, a predetermined primary transfer bias is applied to first transfer roller 5Y, a static electricity force directed from photoreceptor 1Y to first transfer roller 5Y acts upon the toner image, and the toner image on photoreceptor 1Y is transferred to intermediate transfer belt 20. The transfer bias applied at this time has a (positive) polarity opposite to that of the toner (which has negative polarity). Any toner that remains on photoreceptor 1Y is removed by cleaning device 6Y and recovered.

Primary transfer biases respectively applied to the primary transfer roller 5M at the second unit 10M, and the primary transfer rollers 5C and 5K thereafter, are controlled similarly to the primary transfer bias of the first unit. In this manner, intermediate transfer belt 20, to which a yellow toner image has been transferred from the first unit 10Y, is conveyed in sequence past each of the second to fourth units 10M, 10C and 10K, and toner images of each color are superposed in plural transfers.

Intermediate transfer belt 20, to which four toner images have been plurally transferred by the first to fourth units, arrives at a secondary transfer portion which includes intermediate transfer belt 20, support roller 24 that contacts an inner surface of intermediate transfer belt 20, and a secondary transfer roller (secondary transfer unit) 26 provided at an image holding surface side of intermediate transfer belt 20. Meanwhile, recording paper (transfer receiving material) P is supplied at a predetermined timing by a supply mechanism to a gap at which secondary transfer roller 26 and intermediate transfer belt 20 contact with pressure, and a predetermined secondary transfer bias is applied to support roller 24. The transfer bias applied at this time has a (negative) polarity identical to that of the toner (which also has negative polarity), and a static electricity force directed from intermediate transfer belt 20 towards the recording paper P acts upon the toner image, whereby the toner image on intermediate transfer belt 20 is transferred to recording paper P. The secondary transfer bias at this point is determined according to a resistance detected by a resistance detecting unit (not shown) that detects a resistance of the secondary transfer portion, and a voltage of the secondary transfer bias is controlled accordingly.

Subsequently, recording paper P is sent to a fixing device 28, and the toner image is heated, whereby the toner image of superposed colors melts and is fixed on recording paper P. Recording paper P, at which color image fixing has been completed, is then sent to an ejection portion, at which point a sequence of color image formation operations ends. In the image forming device exemplified above, a toner image is transferred to recording paper P via intermediate transfer belt 20; however, the invention is not limited to this configuration, and may also have a structure in which a toner image is transferred directly from a photoreceptor to a recording paper.

Process Cartridge and Toner Cartridge

Figure 2:
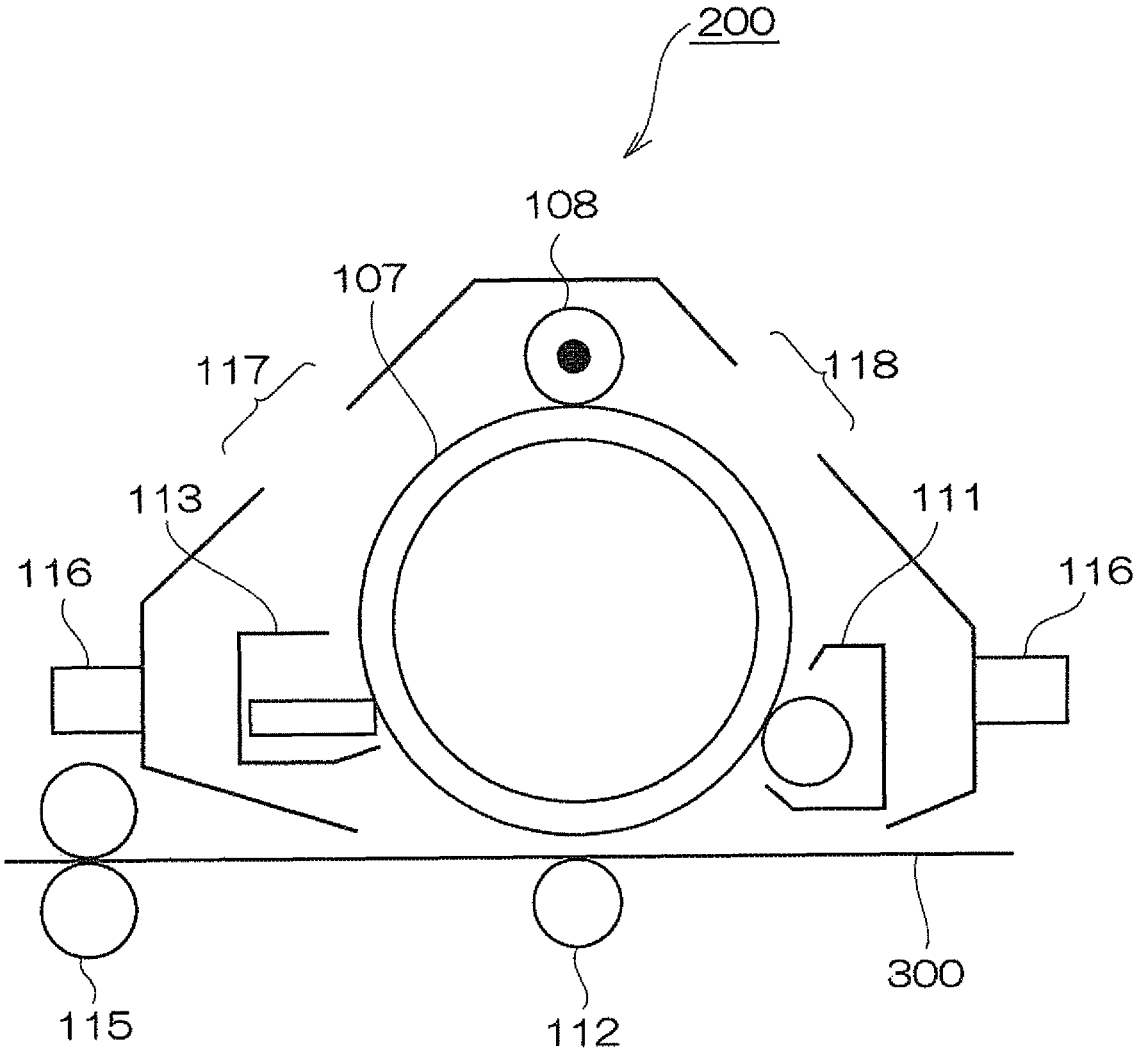
FIG. 2 is a drawing showing an example of the process cartridge of an exemplary embodiment.

FIG. 2 is a schematic drawing showing the configuration of an example of a process cartridge that accommodates the electrostatic charge image developer according to the present embodiment. Process cartridge 200 includes, integrally, a photoreceptor 107, a charge roller 108, a developing device 111, a photoreceptor cleaning device 113, an opening portion 118 for exposure, and an opening portion 117 for charge removal exposure, which are combined using mounting rails 116. Reference numeral 300 in FIG. 2 indicates a receiving material. Process cartridge 200 may be removably mounted to an image forming device body including a transfer device 112, a fixing device 115 and other elements not shown in the drawings, and forms an image forming device together with the image forming device body.

In the process cartridge shown in FIG. 2, a charge roller 108, a developing device 111, a cleaning device 113, an opening portion 118 for exposure and an opening portion 117 for charge removal exposure are provided; however, these devices may be selectively combined as appropriate. The process cartridge according to the present embodiment, in addition to a photoreceptor 107, may also be provided with at least one selected from a charge roller 108, a developing device 111, a photoreceptor cleaning device 113, an opening portion 118 for exposure or an opening portion 117 for charge removal exposure.

Next, the toner cartridge according to the present embodiment will be described. The toner cartridge according to the present embodiment is removably mounted at the image forming device (i.e., attachable to and detachable from the image forming device), and is at least a toner cartridge that accommodates a toner for supply to a development unit provided within the image forming device, in which the toner is the above toner according to the present embodiment. The toner cartridge according to the present embodiment at least accommodates a toner, but may also accommodate a developer or the like depending on the structure of the image forming device.

Thus, in an image forming device to which a toner cartridge may be removably mounted, by using a toner cartridge that accommodates the toner according to the present embodiment, the toner according to the present embodiment can be easily supplied to a developing device.

The image forming device shown in FIG. 1 is an image forming device at which toner cartridges 8Y, 8M, 8C and 8K may be removably mounted, and developing devices 4Y, 4M, 4C, and 4K are respectively connected to toner cartridges that correspond to the developing device (to the color), and to a toner supply line. When the toner accommodated in the toner cartridge runs low, the toner cartridge may be replaced.

EXAMPLES

In the following, the present exemplary embodiment is explained in further detail with reference to examples and comparative examples; however, the present exemplary embodiment is not in any way limited to these Examples.

Preparation of Toner

—Synthesis of Crystalline Polyester Resin—

98 mol % of dimethyl sebacate, 2 mol % of dimethyl isophthalate, 100 mol % of ethylene glycol and, as a catalyst, 0.2 parts by weight of dibutyl tin oxide relative to 100 parts by weight of the monomer component are placed in a three-necked flask that has been heated and dried, after which the inside of the flask is provided with an inert atmosphere by a pressure reduction operation using nitrogen gas, and stirring and reflux are performed for five hours at 180° C. by mechanical stirring.

Then, the temperature is gradually raised to 230° C. under reduced pressure and stirring is performed for two hours. Then, when a viscous state is achieved, air cooling is performed and the reaction is terminated, whereby a crystalline polyester resin is synthesized. The weight-average molecular weight (Mw) of the obtained crystalline polyester resin as measured by gel permeation chromatography molecular weight measurement (in terms of polystyrene-equivalent value) is 9700.

—Synthesis of Non-Crystalline Polyester Resin—

| | |
|---|---|
| Terephthalic acid: | 30 mol % |
| Fumaric acid: | 70 mol % |
| Bisphenol A ethylene oxide 2 mol adduct: | 20 mol % |
| Bisphenol A propylene oxide adduct: | 80 mol % |

The above monomers are placed in a flask having an internal capacity of 5 liters and equipped with a stirring device, a nitrogen introduction pipe, a temperature sensor and a rectifier. The temperature is raised to 190° C. over one hour and, after it has been confirmed that the content of the reaction system has been evenly stirred, 1.2 parts by weight of dibutyl tin oxide relative to 100 parts by weight of the monomer component are added.

While removing any water generated, the resultant is heated from 190° C. to 240° C. over six hours and a dehydration condensation reaction is continued for a further three hours at 240° C., thereby providing a non-crystalline polyester resin having an acid value of 12.0 mg/KOH and a weight-average molecular weight of 12700.

—Preparation of Toner Particles 1—

| | |
|---|---|
| Non-crystalline polyester resin | 75 parts by weight |
| Crystalline polyester resin | 10 parts by weight |
| Monoazo pigment (trade name: C.I. Y-74; manufactured by Dainichiseika Color & Chemicals Mfg. Co., Ltd.) | 5 parts by weight |
| Paraffin wax HNP 9 (melting temperature: 75° C.; manufactured by Nippon Seiro Co., Ltd.) | 8 parts by weight |
| Metatitanic acid subjected to hydrophobizing treatment as described below | 2 parts by weight |

The above components are mixed in a Henschel Mixer and then kneading is performed using a two-screw kneader. The obtained kneaded substance is subjected to cooling and rolling by a water-cooling cooling conveyor, crushing is performed using a pin crusher, and further crushing is performed using a hammer mill to obtain a particle diameter of approximately 300 μm. The crushed substance is pulverized in an fluidized-bed mill AFG400 (manufactured by Alpine Gmbh), after which toner particles 1 having a volume-average particle diameter (D50v) of 6.1 μm are obtained using a classifier EJ30. At this time, metatitanic acid is continuously supplied via the supply port of the fluidized-bed mill AFG400 at a ratio of 1 part by weight relative to 100 parts by weight of the crushed substance.

—Preparation of Toner Particles 2—

Toner particles 2 having a volume-average particle diameter (D50v) of 5.9 μm are prepared in the same manner as toner particles 1 except that the 5 parts by weight of monoazo pigment used in the preparation of toner particles 1 is changed to 8 parts by weight of naphthol pigment (trade name: C. I. R-112; manufactured by Dainichiseika Color & Chemicals Mfg. Co., Ltd.).

External Additive

—Preparation of Metatitanic Acid—

Firstly, using ilmenite as an ore, iron powder is removed after dissolution of the ore in sulfuric acid, $TiOSO_4$ is subjected to hydrolysis and $TiO(OH)_2$ is prepared using a wet sedimentation method of generating $TiO(OH)_2$. Further, in the process of preparing $TiO(OH)_2$, dispersion adjustment and washing with water are performed for hydrolysis and nucleation.

100 parts by weight of the obtained $TiO(OH)_2$ are dispersed in 1000 parts by weight of water, and 20 parts by weight of isobutyl trimethoxysilane are dripped into the dispersion at ambient temperature (25° C.) while stirring. The resultant is repeatedly filtered and washed with water. Then, metatitanic acid, the surface of which has been subjected to hydrophobizing treatment with isobutyl trimethoxysilane, is dried at 150° C., whereby hydrophobized metatitanic acid having a volume-average particle diameter of 20 nm, a BET specific surface area of 132 $m^2/g$ and specific gravity of 3.4 is prepared.

Further, a non-hydrophobized metatitanic acid having a volume-average particle diameter of 39 nm, a BET specific surface area of 119 $m^2/g$ and specific gravity of 3.4 is prepared in the same manner except that hydrophobizing treatment is not performed.

—Preparation of Hydrophobic Silicon Oxide 1—

Trimethoxysilane is dripped into a solution including pure water and alcohol and ammonia water as a catalyst while heating, and stirred. The silica sol suspension produced by the reaction is subjected to centrifuge separation and wet silica gel is isolated. A solvent is added to the wet silica gel to return it to a silica sol state, 8 parts by weight of HMDS (hexamethyl disilazane) are added relative to 100 parts by weight of the wet silica gel, and the surface imparted with water-repellency. The solvent is removed after the treatment and the resultant dried at 120° C. and crushed, providing hydrophobic silicon oxide 1 having a volume-average particle diameter of 72 nm.

—Fluoropolymer Particles: Preparation of Polytetrafluoroethylene (PTFE)—

Pure water, ammonium persulfate as a polymerization initiator, paraffin wax for controlling generation of aggregates and ammonium perfluorocarboxylate as an emulsifier are placed in an autoclave. Then, TFE (tetrafluoroethylene) is introduced while stirring and a reaction commenced. At this time, the reaction takes place at a pressure of 1.2 MPa and a temperature of 30° C. inside the system. After the reaction, filtration, washing and drying are performed and PTFE particles with a primary particle diameter of 220 nm are obtained. The weight-average molecular weight of the fluoropolymer particles is 420,000.

Production of Toner A 0.6 parts by weight of hydrophobized metatitanic acid and 2.7 parts by weight of hydrophobic silicon oxide 1 are added to 100 parts by weight of toner particles 1, and toner A is produced by stirring for ten minutes at 2500 rpm using a Hensehel Mixer. The addition weight ratio of the metatitanic acid to the silicon oxide is 1:4.5.

Production of Toner B

Toner B is prepared in the same manner as toner A except that the amount of silicon oxide added is changed to 0.15 parts by weight. The addition weight ratio of the metatitanic acid to the silicon oxide is 1:0.25.

Production of Toner C

Toner C is prepared in the same manner as toner A except that the amount of silicon oxide added is changed to 2.4 parts by weight. The addition weight ratio of the metatitanic acid to the silicon oxide is 1:4.0.

Production of Toner D

Toner D is prepared in the same manner as toner A except that the amount of silicon oxide added is changed to 3.6 parts by weight. The addition weight ratio of the metatitanic acid to the silicon oxide is 1:6.0.

Production of Toner E

Toner E is prepared in the same manner as toner A except that the amount of silicon oxide added is changed to 0.06 parts by weight. The addition weight ratio of the metatitanic acid to the silicon oxide is 1:0.1.

Production of Toner F

Toner F is prepared in the same manner as toner A except that the amount of silicon oxide added is changed to 4.8 parts by weight. The addition weight ratio of the metatitanic acid to the silicon oxide is 1:8.0.

Production of Toner G

Toner G is prepared in the same manner as toner A except that the amount of silicon oxide added is changed to 0.03 parts by weight. The addition weight ratio of the metatitanic acid to the silicon oxide is 1:0.05.

Production of Toner H

Toner H is prepared in the same manner as toner A except that the amount of silicon oxide added is changed to 6.0 parts by weight. The addition weight ratio of the metatitanic acid to the silicon oxide is 1:10.0.

Production of Toner I

Toner I is prepared in the same manner as toner A except that silicon oxide is not added.

Production of Toner J 0.8 parts by weight of hydrophobized metatitanic acid and 3.6 parts by weight of fluoropolymer particles (PTFE) are added to 100 parts by weight of toner particles 2, and toner J is produced by stirring for ten minutes at 2500 rpm using a Henschel Mixer. The addition weight ratio of the metatitanic acid to the fluoropolymer particles is 1:4.5.

Production of Toner K

Toner K is prepared in the same manner as toner J except that the amount of fluoropolymer particles added is changed to 0.18 parts by weight. The addition weight ratio of the metatitanic acid to the fluoropolymer particles is 1:0.23.

Production of Toner L

Toner L is prepared in the same manner as toner J except that the amount of fluoropolymer particles added is changed to 0.8 parts by weight. The addition weight ratio of the metatitanic acid to the fluoropolymer particles is 1:1.0.

Production of Toner M

Toner M is prepared in the same manner as toner J except that the amount of fluoropolymer particles added is changed to 4.6 parts by weight. The addition weight ratio of the metatitanic acid to the fluoropolymer particles is 1:5.8.

Production of Toner N

Toner N is prepared in the same manner as toner J except that the amount of fluoropolymer particles added is changed to 0.08 parts by weight. The addition weight ratio of the metatitanic acid to the fluoropolymer particles is 1:0.1.

Production of Toner O

Toner O is prepared in the same manner as toner J except that the amount of fluoropolymer particles added is changed to 6.4 parts by weight. The addition weight ratio of the metatitanic acid to the fluoropolymer particles is 1:8.0.

Production of Toner P

Toner P is prepared in the same manner as toner J except that the amount of fluoropolymer particles added is changed to 0.04 parts by weight. The addition weight ratio of the metatitanic acid to the fluoropolymer particles is 1:0.05.

Production of Toner Q

Toner Q is prepared in the same manner as toner J except that the amount of fluoropolymer particles added is changed to 6.8 parts by weight. The addition weight ratio of the metatitanic acid to the fluoropolymer particles is 1:8.5.

Production of Toner R

Toner R is prepared in the same manner as toner J except that fluoropolymer particles are not added.

Preparation of Carrier

| | |
|---|---|
| Ferrite particles (volume-average particle diameter: 35 μm; volume resistivity: $3 \times 10^8$ Ω·cm) | 100 parts by weight |
| Toluene | 14 parts by weight |
| Perfluorooctyl ethyl acrylate/methyl methacrylate copolymer (copolymerization ratio: 40:60 (weight standard); Mw = 50,000) | 1.6 parts by weight |
| Carbon black (VXC-72; manufactured by Cabot Corporation) | 0.12 parts by weight |
| Cross-linked melamine resin (number-average particle diameter: 0.3 μm) | 0.3 parts by weight |

Among the above components, the components other than the ferrite particles are dispersed by a stirrer for ten minutes, whereby a solution for forming a coating film is prepared. The coating film forming solution and the ferrite particles are placed in a vacuum deaeration kneader and stirred for 30 minutes at 60° C., whereafter the pressure is reduced, the toluene removed and ferrite particles having a resin coating film on the surfaces thereof are formed, thereby producing a carrier.

Preparation of Developer A

Developer A is prepared by stirring 6 parts by weight of toner A and 96 parts by weight of the carrier in a V-type blender for 5 minutes.

Developers B to R are prepared in the same manner as developer A except that toner A is respectively replaced with toners B to R.

Production of Image

The respective developers are used in a DocuCentre-IIIC3300 (manufactured by Fuji Xerox Co., Ltd.) to produce 5 cm×5 cm image patches with the amount of toner applied fixed at 6 g/m$^2$. P paper (manufactured by Fuji Xerox Co., Ltd.) is used.

—Evaluation of Lightfastness—

Color change in the image patches is measured using a SUNTEST CPS+ (manufactured by Toyo Seiki Seisakusho Ltd.) and a xenon lamp light source, while varying the irradiation time on the image patches obtained as above. Color measurement is performed using an X-Rite 968 (manufactured by X-Rite, Inc.) and calculated according to the equation $\Delta E=\{(L^*-L^*_{ini})^2+(a^*-a^*_{ini})^2+(b^*-b^*_{ini})^2\}^{0.5}$. Here, $L^*_{ini}$, $a^*_{ini}$, $b^*_{ini}$ indicate the initial hue and color saturation measured according to Japanese Industrial Standard Z 8729: 2004 (Method for Displaying a Color) and L*a*b* indicate the hue and color saturation after 120 hours. The acceptable range of ΔE after 120 hours is set at ΔE≤20. A smaller value for ΔE is more favorable. The results are shown in Table 1.

—Initial Image Quality—

Ten 5 cm×5 cm image patches are produced and the total number of white spots in the ten images is ascertained. Zero white spots is the optimal result and five white spots is the acceptable upper limit. The results are shown in Table 1.

TABLE 1

| | Developer | Light Fastness (ΔE) | Initial White Spot Number |
|---|---|---|---|
| Example 1 | A | 9.5 | 2 |
| Example 2 | B | 9.8 | 2 |
| Example 3 | C | 9.1 | 3 |
| Example 4 | D | 8.8 | 4 |
| Example 5 | E | 19.2 | 1 |
| Example 6 | F | 7.8 | 5 |
| Example 7 | J | 8.1 | 1 |
| Example 8 | K | 8.8 | 0 |
| Example 9 | L | 8.4 | 0 |
| Example 10 | M | 7.4 | 3 |
| Example 11 | N | 16.7 | 0 |
| Example 12 | O | 6.2 | 4 |
| Comparative Example 1 | G | 28.3 | 0 |
| Comparative Example 2 | H | 7.3 | 8 |
| Comparative Example 3 | I | 32 | 0 |
| Comparative Example 4 | P | 26.8 | 0 |
| Comparative Example 5 | Q | 6 | 7 |
| Comparative Example 6 | R | 33.1 | 0 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrostatic charge image development, comprising:

toner mother particles including a release agent, a colorant, and a binder resin containing a crystalline resin; and an external additive to the toner mother particles, the external additive comprising at least metatitanic acid and fluoropolymer particles, wherein the amount of the fluoropolymer particles included in the toner is from approximately 0.1 parts by weight to approximately 0.8 parts by weight relative to 100 parts by weight of the toner mother particles, the weight ratio of the metatitanic acid to the fluoropolymer particles is from approximately 1:0.08 to approximately 1:8.30, and the number average particle diameter of the metatitanic acid particles is from 20 nm to 40 nm.

2. The toner for electrostatic charge image development of claim 1, wherein the weight-average molecular weight of the fluoropolymer particles is from approximately 200,000 to approximately 800,000.

3. The toner for electrostatic charge image development of claim 1, wherein the colorant is a monoazo pigment or a naphthol pigment.

4. The toner for electrostatic charge image development of claim 1, wherein the crystalline resin is a crystalline polyester resin containing a diol-derived component derived from a straight-chain aliphatic diol, the main chain portion of which has from 7 to 20 carbon atoms.

5. The toner for electrostatic charge image development of claim 1, wherein the melting temperature of the crystalline resin is approximately from 50° C. to approximately 100° C.

6. The toner for electrostatic charge image development of claim 1, wherein the crystalline resin has a weight-average molecular weight (Mw) of from 5000 to 60,000.

7. The toner for electrostatic charge image development of claim 1, wherein the binder resin further includes a non-crystalline resin, and the content ratio of the crystalline resin to the non-crystalline resin by weight is from approximately 4:96 to approximately 20:80.

8. The toner for electrostatic charge image development of claim 7, wherein the non-crystalline resin has a weight-average molecular weight (Mw) of from approximately 5000 to approximately 1,000,000.

9. The toner for electrostatic charge image development of claim 7, wherein the non-crystalline resin has a molecular weight distribution (Mw/Mn) of from approximately 1.5 to approximately 100, Mw representing the weight-average molecular weight and Mn representing number-average molecular weight.

10. The toner for electrostatic charge image development of claim 7, wherein the non-crystalline resin has a softening temperature of from approximately 80° C. to approximately 130° C.

11. The toner for electrostatic charge image development of claim 1, wherein the release agent is a substance having a main endothermic peak as measured in compliance with ASTMD 3418-8 in the range of from approximately 50° C. to approximately 140° C.

12. The toner for electrostatic charge image development of claim 1, wherein the viscosity η1 of the release agent at 160° C. is in the range of from approximately 20 mPa·s to approximately 200 mPa·s.

13. An electrostatic charge image developer comprising the toner for electrostatic charge image development of claim 1 and a carrier.

14. The electrostatic charge image developer of claim 13, wherein the carrier includes a core having an electrical resistance of from approximately $1\times10^{7.5}$ Ω·cm to approximately $1\times10^{9.5}$ Ω·cm.

15. A toner cartridge that is attachable to and detachable from an image forming device and that holds toner that is to be supplied to a development unit provided within the image forming device, wherein the toner is the toner for electrostatic charge image development of claim 1.

16. The toner for electrostatic charge image development of claim 1, wherein the weight ratio of the metatitanic acid to the fluoropolymer particles is from 1:0.20 to 1:6.00.

17. The toner for electrostatic charge image development of claim 1, wherein the weight ratio of the metatitanic acid to the fluoropolymer particles is from 1:0.20 to 1:4.50.

18. The toner for electrostatic charge image development of claim 1, wherein the fluoropolymer particles are selected from the group consisting of polytetrafluoroethylene, tetrafluoroethylne/hexafluoropropylene copolymer, and tetrafluoroethylene/perfluoroalkyl vinyl ether copolymer.

19. A toner for electrostatic charge image development, comprising:

toner mother particles including a release agent, a colorant, and a binder resin containing a crystalline resin; and an external additive to the toner mother particles, the external additive comprising at least metatitanic acid and at least one selected from the group consisting of silicon oxide and fluoropolymer particles, wherein the weight ratio of the metatitanic acid to the at least one selected from the group consisting of silicon oxide and fluoropolymer particles is approximately 1:0.08 to approximately 1:8.30, when the external additive includes fluoropolymer particles, the amount of the fluoropolymer particles included in the toner is from approximately 0.1 parts by weight to approximately 0.8 parts by weight relative to 100 parts by weight of the toner mother particles, when the external additive includes silicon oxide, the amount of silicon oxide included in the toner is from 0.5 parts by weight to 2.5 parts by weight relative to 100 parts by weight of the toner mother particles, the number average particle diameter of the metatitanic acid particles is from 20 nm to 40 nm, and the toner mother particles are configured such that the toner has a core portion and a shell portion, and the toner mother particles comprise the crystalline resin at the core portion.

20. The toner for electrostatic charge image development of claim 19, wherein the external additive comprises at least metatitanic acid and fluoropolymer particles, the fluoropolymer particles being selected from the group consisting of polytetrafluoroethylene, tetrafluoroethylne/hexafluoropropylene copolymer, and tetrafluoroethylene/perfluoroalkyl vinyl ether copolymer.

* * * * *